US005249025A

United States Patent [19]

Nakazawa et al.

[11] Patent Number: 5,249,025

[45] Date of Patent: Sep. 28, 1993

[54] IMAGE FORMING APPARATUS HAVING CLEANING MEANS

[75] Inventors: Nobuo Nakazawa; Akimitsu Hoshi, both of Kawasaki; Nobuyuki Kume, Yokohama, all of Japan

[73] Assignee: Canon Kabushiki Kaisha, Tokyo, Japan

[21] Appl. No.: 859,270

[22] Filed: Mar. 25, 1992

Related U.S. Application Data

[63] Continuation of Ser. No. 413,737, Sep. 28, 1989, abandoned.

[30] Foreign Application Priority Data

Sep. 29, 1988 [JP] Japan ..... 63-242343
Sep. 29, 1988 [JP] Japan ..... 63-242345

[51] Int. Cl.[5] ..... G03G 21/00

[52] U.S. Cl. ..... 355/297; 118/652; 355/305

[58] Field of Search ..... 118/652; 355/297, 299, 355/305, 306

[56] References Cited

U.S. PATENT DOCUMENTS 3,918,808 11/1975 Narita ..... 355/299
4,370,049 1/1983 Kuge et al. ..... 355/251
4,426,151 1/1984 Aguro et al. ..... 355/299
4,671,641 6/1987 Kohyama ..... 355/305 X
4,674,865 6/1987 Tada et al. ..... 355/215
4,711,555 12/1987 Toshimitsu et al. ..... 355/299
4,739,370 4/1988 Yoshida et al. ..... 355/296
4,972,233 11/1990 Yamazaki et al. ..... 355/306
5,027,161 6/1991 Kume et al. ..... 355/305

FOREIGN PATENT DOCUMENTS 3151219 5/1982 Fed. Rep. of Germany .
56-52767 5/1981 Japan .
58-130373 10/1983 Japan .

*Primary Examiner*—Fred L. Braun
*Attorney, Agent, or Firm*—Fitzpatrick, Cella, Harper & Scinto

[57] ABSTRACT

An image forming apparatus includes a cleaning member which frictionally contacts magnetic particles on a magnet roller with an image bearing member in order to remove foreign matter adhered to the image bearing member, thereby preventing the deteriorating of the image quality. The magnet roller rotates slowly so that a portion thereof opposed to the image bearing member is moved in the same direction as a moving direction of the image bearing member. This prevents the toner from overflowing and scattering out of the cleaning member. Further, when non-magnetic toner is used, by providing a toner cavity on the magnet roller, the scattering of the non-magnetic toner can be prevented, whereby parts inside the apparatus are prevented from being contaminated by the toner.

63 Claims, 5 Drawing Sheets

IMAGE FORMING APPARATUS HAVING CLEANING MEANS

This application is a continuation of application Ser. No. 07/413,737 filed Sept. 28, 1989, now abandoned.

BACKGROUND OF THE INVENTION

Field of the Invention

The present invention relates to an image forming apparatus such as a electrophotographic copying machine, printer and the like, which utilizes an electrostatic recording process, and more particularly, it relates to an image forming apparatus having a cleaning means for cleaning the residual toner which remains on an image bearing member.

Related Background Art

In an image forming apparatus wherein the processes for transferring an image formed on a surface of an image bearing member such as a photosensitive member onto a transfer material mainly comprising a paper are repeated, it is inevitably required that the residual toner which is not transferred onto the transfer material and still remains on the image bearing member to be adequately removed.

Various cleaning means for removing such residual toner have been proposed. Among them, a cleaning means wherein the residual toner is scraped off from the image bearing member by a cleaning blade comprising an elastic material such as a urethane rubber has been widely used, since the structure thereof if simple and compact, and it has an excellent toner removing ability.

However, in such an image forming apparatus, the quality of the image is badly influenced not only by the toner adhered to the image bearing member, but also by foreign matter such as fine paper powder generated from the paper used as the transfer material. In most cases, with these image forming apparatus, organic components generated from such paper powder, and corona products generated due to the presence of a high voltage element such as a corona charger provided in the image forming apparatus, adhere to the image bearing member. In particular, it is considered that, under high humidity circumstances, since such foreign matter causes low resistance to prevent the image bearing member from being charged to the desired potential, the formation of a sharp latent image is prevented, thus resulting in deterioration of the image quality (such as the flow of image).

It is known that the above-mentioned deterioration of the image quality is particularly apt to occur in the case of an amorphous photosensitive material in which the film is obtained by electrolysis of a silane group due to glow discharge.

In order to avoid such a drawback, particularly in the case where a single component magnetic toner is used, there has been proposed a technique wherein a magnet roller is arranged on an upstream side of a cleaning blade with respect to a moving direction of the image bearing member, a magnetic brush is formed on a magnet roller by a portion of the toner collected in a cleaning device, and the magnetic toner is supplied again to the image bearing member by contacting the magnetic brush with the image bearing member, so that the above-mentioned foreign matter are frictionally removed by an abrasion action due to the toner particles at positions where the cleaning blade and the magnetic brush were engaged by the image bearing member.

In comparison with a method wherein the additional abrasive is frictionally engaged by the image bearing member through a web, rubber roller or the like, the above-mentioned technique is superior in the points that the abrasion action is less localized or offset on the surface of the image bearing member due to the adhesion of the toner onto the web, rubber roller or the like. The surface of the image bearing member is less damaged since the rubber roller and the like is not frictionally pressed against the image bearing member. Further, the above-mentioned technique can be applied to a photosensitive member in a so-called Carlson process wherein the charges are moved within the photosensitive layer during the exposure operation. Accordingly, by combining additional means such as means for heating the photosensitive member to decrease the surrounding humidity and/or means for forcibly excluding the generated ozone and/or nitride to the above-mentioned technique, the deterioration of the image quality due to the above-mentioned factors has been effectively prevented more or less.

In the cleaning system wherein the magnetic brush is formed on the magnet roller by the magnetic toner, it is known that the magnet roller is rotated so that a portion of the magnet roller opposed to the image bearing member is moved in a direction opposite to a moving direction of the image bearing member. However, when a great number of originals or manuscripts each of which uses or consumes relatively high amounts of toner are copied, the toner often fills up or overflows from the cleaning device, and contaminates various parts in the image forming apparatus.

On the other hand, recently, an image forming apparatus wherein plural toner developers having different colors are used with the apparatus, and such toner developers are selectively utilized to obtain a multicolor image, has been willingly used.

In such image forming apparatus, generally, the color toner comprises colored dyes, pigments and transparent resins, and is normally non-magnetic. On the other hand, also in the image forming apparatus of this kind, the single component magnetic toner suitable for forming the black image is still often used. In this case, even if the cleaning means utilizing the above-mentioned magnet roller is used, it is difficult to collect or catch the non-magnetic toner. As a result, there arose a problem that the non-collected toner was scattered into the apparatus, thus contaminating the various parts of the apparatus, or the non-collected toner was jammed between the magnet roller and the image bearing member, thus preventing the cleaning action.

Furthermore, recently, an amorphous silicone photosensitive member has been widely used as a photosensitive layer for the surface of the image bearing member in a high speed copying machine and the like, since such amorphous silicone photosensitive member has a great mechanical strength and is durable. However, in such a copying machine, since the magnet roller often used for cleaning the magnetic toner is not used and the toner is removed only by the cleaning blade, the accumulation of the foreign matter as aforementioned, the poor cleaning action due to such accumulation of the foreign matter, the turning-over of the cleaning blade and/or the flow of the image cannot be prevented. Further, in the cleaning system wherein the magnetic brush is formed by the magnetic toner, it is considered that the magnet roller is rotated so that a portion of the magnet roller opposed to 0 the image bearing member is moved in a direction opposite to a moving direction of the image bearing member. However, if an adequate amount of toner is used for completely coating the surface of the image to stably perform the cleaning action in this cleaning system, as mentioned above, when a great number of originals or manuscripts each of which uses or consumes relatively much toner are copied, the toner often overflows from the cleaning device and/or the magnetic toner is scattered during the collection thereof, thus contaminating various parts in the image forming apparatus.

SUMMARY OF THE INVENTION

An object of the present invention is to provide an image forming apparatus which can eliminate the above-mentioned conventional drawbacks and can prevent the overflow of the toner from a cleaning device and the scattering of the toner.

Another object of the present invention is to provide an image forming apparatus having a cleaning means which can prevent the poor cleaning action and can always perform a stable cleaning action.

A further object of the present invention is to provide an image forming apparatus which can prevent the deterioration of image quality due to foreign matter on an image bearing member and can obtain a good image.

The other object of the present invention is to provide an image forming apparatus which can prevent the leakage of toner from a magnetic particle holding means for frictionally sliding the magnetic particles on an image bearing member.

DETAILED DESCRIPTION OF THE PREFERRED EMBODIMENTS

The present invention will now be explained in connection with embodiments thereof with reference to the accompanying drawings.

Figure 1:
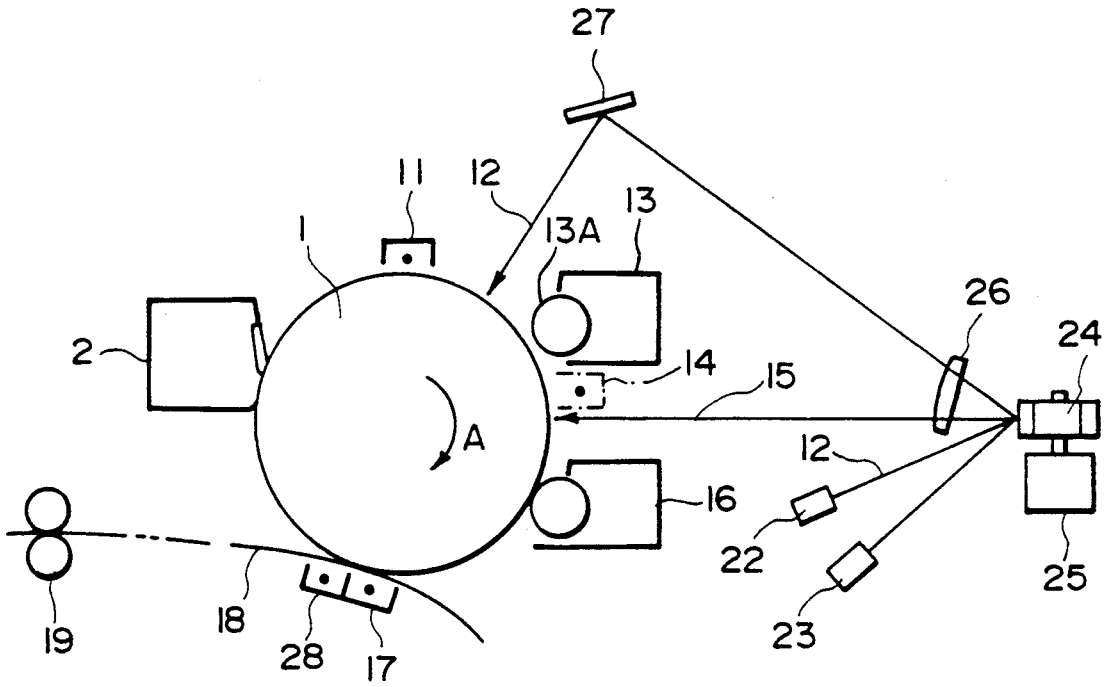
FIG. 1 is a schematic sectional view of an image forming apparatus according to a preferred embodiment of the present invention.

FIG. 1 schematically shows an example of an electrophotographic apparatus embodying an image forming apparatus according to the present invention, which can perform two color recording.

According to the illustrated embodiment, a drum-shaped image bearing member, i.e., an electrophotographic photosensitive drum 1 having a light conductive layer such as an amorphous silicone layer arranged on a surface thereof is supported for rotational movement in a direction shown by the arrow A, and an image forming means is arranged around the drum. That is to say, around the photosensitive drum 1, a first charger 11, a first image exposure means 12, a first developing device 13, a second image exposure means 15, a second developing device 16, a transfer charger 17, and a cleaning means 2 are arranged. If necessary, a pre-exposure means (not shown) may be provided between the cleaning means 2 and the first charger 11.

Further, the first and second image exposure means 12, 15 include a first semi-conductor laser unit 22 for emitting a first laser beam modulated by a first image signal, a second semi-conductor laser unit 23 for emitting a second laser beam, and a rotatable polygon mirror 24 driven by a motor 25, for deflecting the first and second laser beams and for raster scanning first and second images on the photosensitive drum 1 through a focusing lens 26 and a reflection mirror 27. As will be described later, a second (or re-charging) charger 14 may be provided between the first developing device 13 and the second image exposure means 15.

The photosensitive drum 1 rotating in the direction A is uniformly charged by the first charger 11, for example, to the voltage of +460 V. A first latent image wherein the surface potential of an exposure portion thereof will be charged, for example, to the voltage of +11 V is formed on the photosensitive drum 1 by means of the first exposure means 12. The first latent image is developed as an inverse image by means of the first developing device 13 including, for example, red toner positively charged, by applying a bias current having an appropriate magnitude. Here, as the red toner, non-magnetic toner having an average particle diameter of 10–13 μm, and the non-magnetic toner is charged due to the friction charging by agitating the toner with carrier obtained by coating spherical ferrite particles constituting magnetic powder and having an average particle diameter of 40–50 μm in the first developing device 13. The non-magnetic toner is held together with the carrier within a sleeve 13A incorporating a magnet therein. The image formed on the photosensitive drum 1 is developed by applying the toner thereto by rotating the sleeve 13A. In this case, the potential of the visualized red toner image is higher than the potential of the toner charge by about 100 V to have a value of about +200 V.

Then, a second image signal is introduced onto the photosensitive drum 1 by the second exposure means 15, whereby a second latent image wherein the surface potential of an exposure portion thereof will be charged, for example, to the voltage of +90 V is formed on the photosensitive drum 1. In this case, as an alternative method, as mentioned above, the second charger 14 may be provided, so that the potential of the first toner image is increased up to the voltage of +420 V by re-charging the photosensitive drum 1 after the first image is visualized, and then the second image exposure 15 is performed, thus decreasing the potential of the exposure portion thereof to the voltage of +60 V.

The second latent image so formed is visualized by applying a bias current having an appropriate magnitude by means of the second developing device 16 including, for example, black toner. Incidentally, in this case, the black toner is constituted by a single component magnetic toner obtained by mixing magnetite with resin and having an average particle diameter of 10–12 μm. Then, the two color images on the photosensitive drum 1 are transferred onto a transfer material 18 normally comprising a paper by means of the transfer charger 17. The transfer material is separated from the photosensitive drum 1 by a separation charger 28, and then the image transferred to the transfer material is fixed onto the latter by means of a fixing means 19. Thereafter, the transfer material is ejected out of the image forming apparatus as a two color print.

On the other hand, the photosensitive drum 1 is treated by the cleaning means 2 to remove the residual toner on the drum, and thereafter, is used again for the next image forming process.

Figure 2:
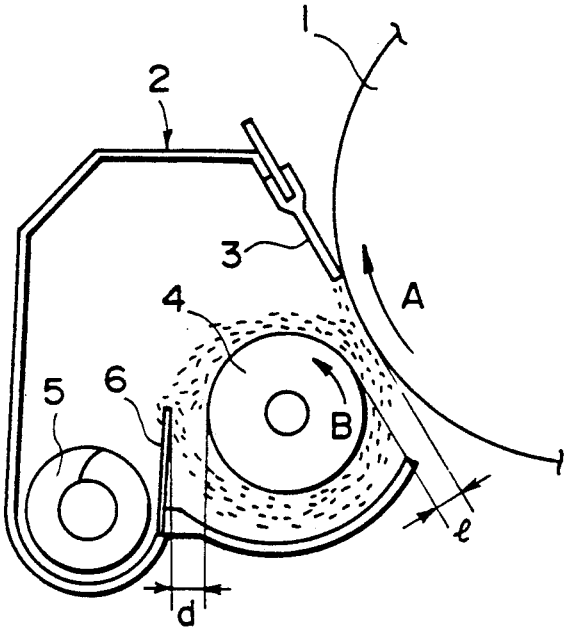
FIG. 2 is a side sectional view of a cleaning device suitable for applying to the image forming apparatus according to the present invention.

FIG. 2 shows a side sectional view of the cleaning means 2. The cleaning means 2 is arranged in parallel with and in the vicinity of the photosensitive drum 1 which is rotated around an axis perpendicular to a plane of FIG. 2 in the direction A.

A cleaning blade 3 as a cleaning member is arranged within the cleaning means 2, and an edge of a free end of the cleaning blade is pressed against the surface of the photosensitive drum 1 to remove the residual toner remaining on the latter without interfering with the transfer action in a transferring station (not shown).

At an upstream side of the cleaning blade 3 with respect to the moving direction of the photosensitive drum 1, a magnet roller 4 as a magnetic particle holding means is arranged with a gap of l mm between the photosensitive drum 1 and the magnet roller, and, as shown, a regulating member 6 for regulating a thickness of a layer of the magnetic particles formed on the magnetic roller 4 to a predetermined value is arranged in the vicinity of the magnetic roller 4 with a gap of d mm between the member 6 and the roller 4.

After the toner image is formed on the photosensitive drum 1 by the magnetic toner, the magnetic toner which has reached the cleaning blade 3 of the cleaning means 2 is scraped off by the blade 3 to drop onto the magnet roller 4, and then is fed by the rotation of the roller 4 to reach the regulating member 6. And, a portion of the toner is attracted by the magnet roller 4 to form a magnetic brush comprising a magnetic particle layer and then reaches a position near the photosensitive drum 1, thus frictionally engaging with the drum surface to remove the materials adhered to the photosensitive drum 1, and then further reaches the cleaning blade 3 by the rotation of the photosensitive drum 1 to be stably supplied to the edge of the cleaning blade as a lubricant agent. Since such magnet roller has an ability for holding the magnetic toner by the magnetic force, it is possible to prevent the toner removed from the drum 1 from leaking out of the cleaning means 2. The magnetic toner layer may be previously formed on the magnet roller.

Next, a result of the tests performed by using the above-mentioned cleaning means 2 will be explained.

The amorphous silicone was used as the photosensitive member, and the peripheral velocity of the photosensitive was selected to 300 mm/sec. A magnet having magnetic flux density of 800 gauss and eight magnetic poles was used as the magnet roller, and was rotated so that a portion of the magnet roller opposed to the surface of the photosensitive member was moved in a direction opposite to the moving direction of the photosensitive member. In these conditions, the relation between the above-mentioned gaps d, l, and the difference between the peripheral velocity of the photosensitive member and that of the magnet roller was examined.

First of all, conditions for generating the drop of the toner and the clogging of the toner in the cleaning means having the construction as mentioned above will be explained with reference to FIGS. 3 and 4.

Figure 3:
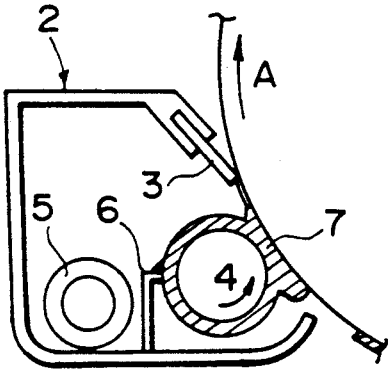
FIGS. 3 and 4 are explanatory views showing conditions that toner is dropped and the toner is overflowed.
Figure 4:
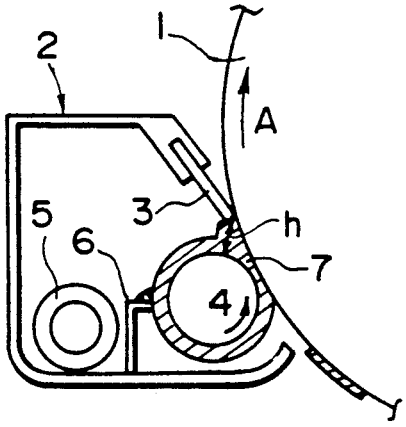

FIG. 3 shows the condition that the toner of the magnetic brush formed on the magnet roller is dropped without being properly fed, and FIG. 4 shows the condition that the toner is clogged or jammed.

Briefly explaining the movement of the toner on the surface of the photosensitive member 1 and on the surface of the magnet roller 4, the toner on the magnet roller 4 is moved in response to the rotation of the magnet roller, whereas the toner on the photosensitive member 1 is moved in response to the movement of the latter. In the portion where the photosensitive member 1 is situated nearest the magnet roller 4, it is considered that the velocity of the toner is an average between the velocity of the photosensitive member and that of the magnet roller.

Dropping of the toner as mentioned above occurs when the amount of the toner fed between the photosensitive member 1 and the magnet roller 4 is greater than the amount of the toner which is to be fed to the cleaning blade 3 through the gap between the photosensitive member and the magnet roller. Accordingly, if the above-mentioned gap d is greater than the gap l, when the amount of the toner passing through the gap l is more than the amount of the supplied toner, the toner will not be dropped.

Figures 5A, 5B, 5C:
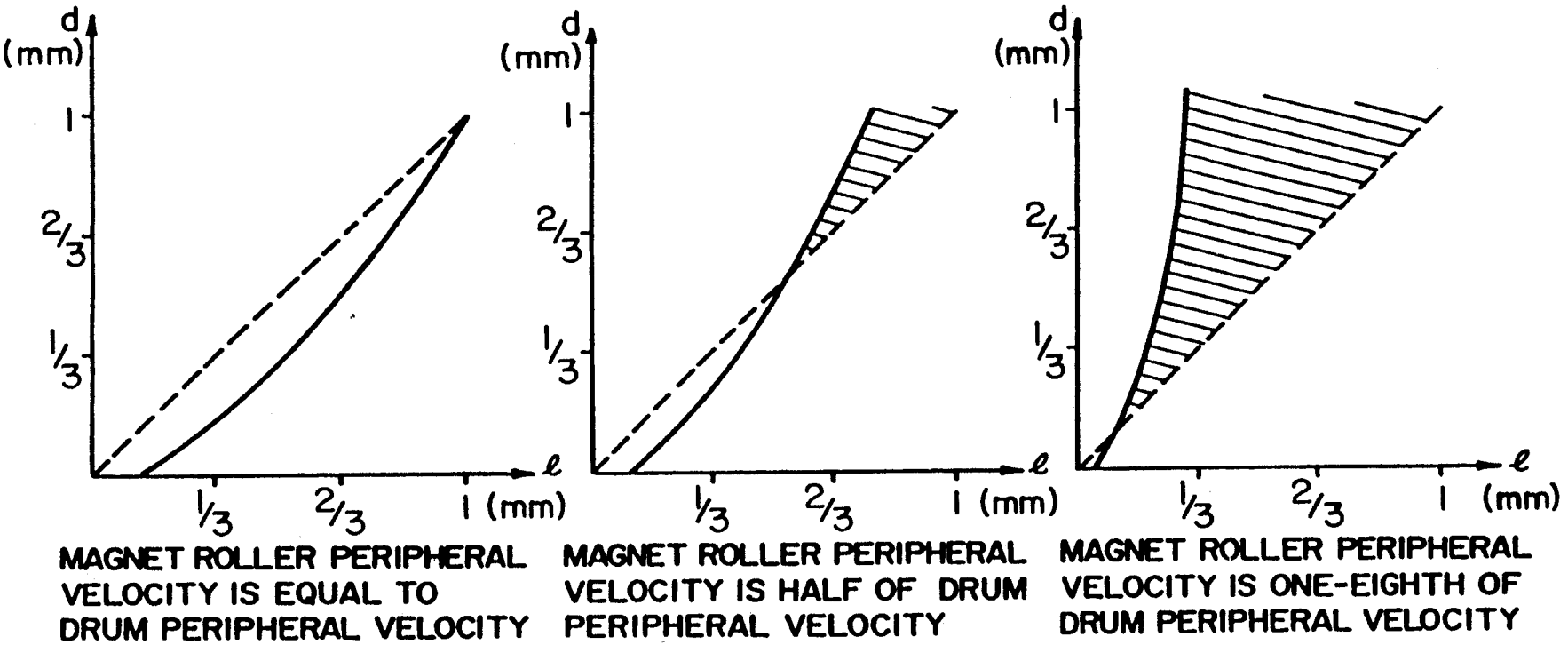
FIGS. 5A to 5C are graphs showing areas where the toner is not dropped, in accordance with the variation between a peripheral velocity of a magnet roller and an image bearing member.

FIGS. 5A to 5C show the relation between the gaps d, l and the drop of the toner due to the peripheral velocity of the magnet roller. That is to say, FIG. 5A shows the condition of the drop of the toner when the gaps d, l are varied in the case where the peripheral velocity of the magnet roller is the same as that of the photosensitive member, FIG. 5B shows the condition of the drop of the toner when the gaps d, l are varied in the case where the peripheral velocity of the magnet roller is an half of that of the photosensitive member, and FIG. 5C shows the condition of the drop of the toner when the gaps d, l are varied in the case where the peripheral velocity of the magnet roller is one-eighth of that of the photosensitive member. In these Figures, each of the hatched zones shows an available area where the toner is not dropped and thus remains on the magnet roller to frictionally slide on the photosensitive member.

As seen in these graphs, in case of FIG. 5A there is no available area, and it will be found that the available area is increased as the peripheral velocity of the magnet roller is decreased.

Next, the above-mentioned clogging of the toner will be fully explained.

It can be easily understood that, if a distance h (mm) shown in FIG. 4, i.e., a distance between the magnet roller 4 and a position where the cleaning blade 3 is abutted against the photosensitive member 1 is adequately long, the clogging of the toner can be prevented. However, in practice, since it is impossible to keep an adequate distance h because the image forming apparatus itself and/or the cleaning means itself (even if the image forming apparatus is large) are desired to be small-sized and be compact, the clogging of the toner is apt to occur. Naturally, the clogging of the toner occurs when the amount of the toner scraped off by the cleaning blade is more than the amount of the toner fed by the magnet roller.

Figure 6:
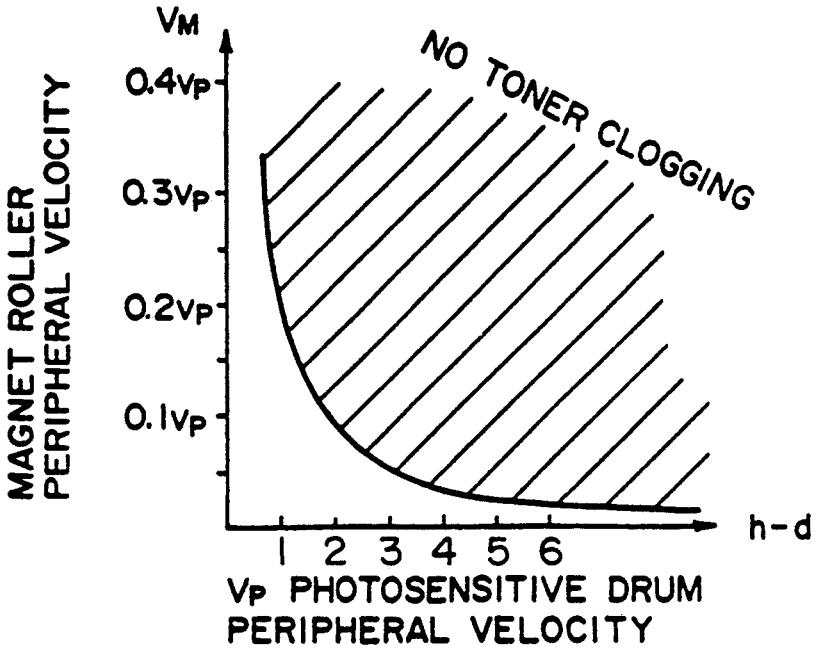
FIG. 6 is a graph showing no toner clogging area, in accordance with the variation between a peripheral velocity of a magneto roller and an image bearing member.

The amount of the toner fed by the magnet roller is proportional to the peripheral velocity of the magnet roller, and the peripheral velocity more than a predetermined value is requested. FIG. 6 shows the relation between the peripheral velocity of the magnet roller and the gap difference (h-d).

The toner clogging phenomenon largely depends upon the amount of the toner being fed by the rotation of the photosensitive member 1. In the tests for obtaining FIG. 6, the amount of the toner being fed to the cleaning means as the residual toner when the black copy or solid image is copied, i.e., when the toner is adhered to the whole area of the copy paper of A4 size was referred to.

The hatched zone shown in FIG. 6 shows the no toner clogging area. It can be understood that the toner clogging becomes less likely as the peripheral velocity of the magnet roller is increased and as the distance between the cleaning blade and the magnet roller is increased.

On the basis of the results as mentioned above, the condition that the toner is not dropped and is not clogged was represented as mathematical expressions experimentally.

First of all, explaining the drop of the toner, as to the above-mentioned gaps d, l, since the magnetic brush on the magnet roller must be fully contacted with the photosensitive member and the magnet roller itself should not be contacted with the photosensitive member, it is required to have the relations not only $l>0$ but also $d>l>0$.

The magnet roller is rotated so that the portion thereof opposed to the photosensitive member is moved in the direction opposite to the moving direction of the photosensitive member (the peripheral velocity of the photosensitive member $V_P>0$, the peripheral velocity of the magnet roller $V_M>0$), and only the peripheral velocity thereof (mm/sec) is referred to.

From the result of the tests, it was found that the area where the toner was not dropped could be defined by the following condition:

$$d<(V_P/V_M)(l-0.15)$$

Also as to the result shown in FIG. 6, the relation between the distance h and the gap d was set to $h>d$, and further, under the condition of $k=3(h-d)-2>0$, the no toner clogging area could be determined on the basis of the following relation:

$$V_M>V_P/3K.$$

Next, the cleaning of the non-magnetic toner will be explained. The residual non-magnetic toner remaining on the photosensitive member after passing through the transfer station has higher triboelectric charge (friction charge) than the magnetic toner without the carrier because the non-magnetic toner is frictionally contacted with not only the developing sleeve but also the carrier particles in the developing device. Such non-magnetic toner is adhered to the photosensitive member with the predetermined tribo-electric charge or more, if the non-magnetic toner entrained by the magnetic brush formed on the magnet roller reaches to the photosensitive member, almost all of the non-magnetic toner is not entrained by the magnet roller but is fed by the photosensitive member 1 to reach the cleaning blade 3, where the toner is scraped off by the cleaning blade to drop onto the magnetic brush formed on the magnet roller surface, thus not leaking out of the cleaning device 2.

The non-magnetic toner dropped on the magnetic brush is fed toward the regulating member 6 positioned at the opposite side of the photosensitive member with being entrained by the magnetic brush, and then almost all of the toner is scraped by the regulating member and is discharged into a toner collecting container (not shown) by a screw feeder 5. Further, in consideration of the scattering of the non-magnetic toner within and out of the cleaning device, since the non-magnetic toner is fed with being supported by the magnet roller surface, it is desirable that the peripheral velocity of the magnet roller is slower, and it was found that such peripheral velocity be preferably one-third of the peripheral velocity of the photosensitive member or less.

On the basis of these conditions, under the circumstances of having a temperature of 32.5° C. and a humidity of 85% RH, 100,000 copy papers were copied with the magnetic toner and 3,000 copy papers were copied with the non-magnetic toner. It was found that there was no flow of image caused by the insufficient charge on the photosensitive member and/or no scattering of the toner out of the cleaning device and the good image quality was maintained to the last operation.

The peripheral velocity of the magnet roller, and the gap d between the magnet roller and the regulating member for regulating the thickness of the toner layer in the image forming apparatus as mentioned above may be defined as timed average values, and thus, even if the magnet roller is rotated faster than the photosensitive drum or stopped for a very short time, or if the gap d is varied with the time, it was found that the same function as mentioned above could be achieved.

Figure 7:
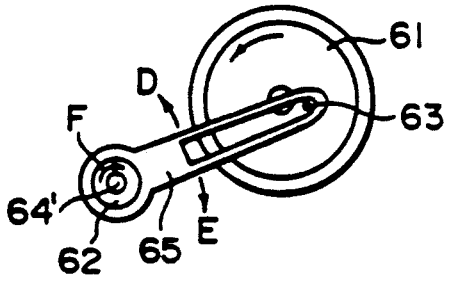
FIG. 7 is a schematic side view showing an example of a speed reduction mechanism to which the present invention can be applied.

FIG. 7 shows an example of a speed reduction mechanism used in such case, where the reference numeral 61 designates a drive gear as a driving source. One end of a rocking lever 65 rotatably mounted on a one-way clutch 62 is fitted on a driven shaft 64' of the magnet roller. When the gear 61 is rotated at a constant speed, the pin 63 is turned around the center of the gear to rock the rocking lever around the one-way clutch 62, in directions D and E alternately. Only when the locking lever 65 is rocked in the direction E, the one-way clutch 62 is rotated in a direction F to intermittently rotate the driven shaft 64' of the magnet roller in the direction F. In this case, a central shaft of the gear 61 may be used as a central shaft of the photosensitive drum.

Figure 8:
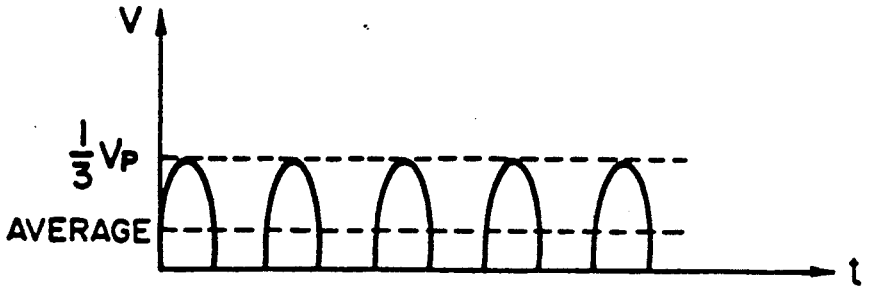
FIG. 8 is a graph showing the relation between the rotation condition of the magnet roller and a time.

The mechanism for suddenly or swiftly reducing the number of revolutions by using such one-way clutch by means of the high speed gear as the driving source requires a small space and is inexpensive, and thus is very advantageous. However, since the driven part is intermittently rotated, the variation of the rotation of the magnet roller with time will be as shown in FIG. 8.

More particularly, even if the peripheral velocity of the magnet roller becomes zero for a very short time, in other words, even if the peripheral velocity of the magnet roller is deviated from the peripheral speed defined in the aforementioned embodiment, the toner is not dropped and is not clogged, thus permitting a smooth cleaning operation. Similarly, if the peripheral velocity of the magnet roller becomes faster than that of the photosensitive drum for a very short time, the toner is also not dropped and is also not clogged, thus permitting a smooth cleaning operation.

Further, the above matter can be referred to the distance d between the magnet roller and the regulating member, and, therefore, there is no problem if the distance d is deviated from the above-mentioned value defined in the aforementioned embodiment for a very short time.

Next, another embodiment of the image forming apparatus will be explained with reference to FIG. 9.

Figure 9:
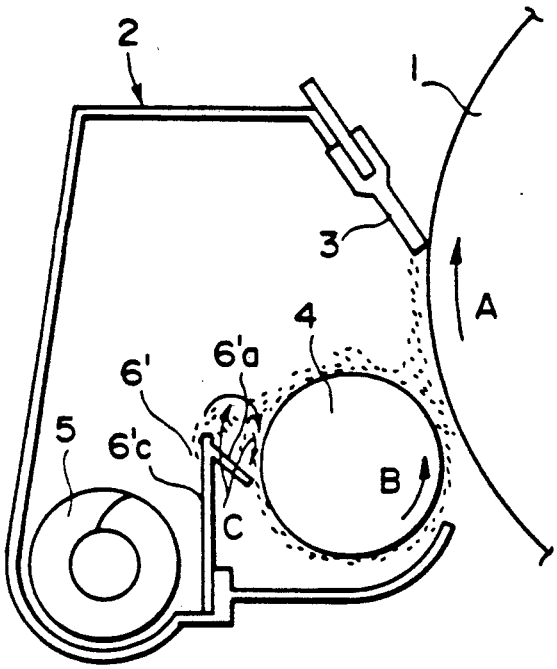
FIGS. 9 and 10 are side sectional view showing cleaning devices according to other embodiments which can be applied to the present invention, respectively.

In the apparatus shown in FIG. 9, a regulating edge portion 6'a formed on the free end of a regulating blade 6' for regulating an amount of the toner accumulated on the surface of the magnet roller 4 is arranged in a "positive direction" in confronting relation to the surface of the magnet roller 4 at the opposite side of the roller 4 with respect to the photosensitive member 1 with an appropriate gap therebetween. Here, the term "positive direction" means a direction that, when a tangential line is formed on the magnet roller at the position nearest to the regulating edge portion 6'a, an angle formed between the regulating edge portion 6'a and a segment of the tangential line upstream of the rotational direction of the magnet roller 4 becomes an acute angle.

With this arrangement, the toner fed by the magnet roller 4 to the regulating blade 6' is largely accumulated into a cavity formed between the regulating edge portion 6'a and the magnet roller 4, and only the toner following out of the cavity is discharged by the screw feeder 5.

Before the operation of the apparatus of FIG. 9 is explained, the movement of the collected toner in the apparatus of FIG. 3 will be briefly explained. When the magnetic toner is used with the apparatus of this kind, since the toner has tendency to be attracted by the magnet roller, even while the excessive toner is being removed by the regulating member 6, the small amount of the toner is adhered to the tip portion of the regulating member 6. However, such amount of the toner is very little.

Thus, when the image forming operation is continued with the copy papers requiring a small amount of the toner, the amount of the toner collected to the cleaning device gradually reduced, thus reducing the amount of toner regulated by the regulating member 6, and, thus in the extreme case, a condition that all of the toner fed by the magnet roller 4 is again fed to the position near the photosensitive member 1 may occur. Further, if a large amount of the toner is fed by the magnet roller 4, since the toner scraped off by the cleaning blade 3 is generally dropped intermittently, the toner is fed with being entrained by the magnet roller in a wave-shaped layer on the roller surface. In this case, merely the toner at the mountain portions of the toner layer is scraped off the regulating member 6, but the toner at the valley portions of the toner layer may not contact the regulating member 6.

Under such condition, for example, after the image forming operations using much red toner are repeated several times, when a large amount of the non-magnetic toner is supplied, since some of the non-magnetic toner naturally passes through the clearance between the toner layer adhered to the magnet roller and the regulating member 6, such toner caught by the magnet roller 4 will be dropped and scattered while being fed toward the position where the magnet roller is nearest the photosensitive member 1.

On the other hand, in the embodiment shown in FIG. 9, the cavity or portion into which a large amount of the toner can be accumulated is provided at the position where the magnetic toner entrained by the magnet roller is regulated by the regulating blade 6'. With this arrangement, if the image forming operations using less toner are continue the magnetic toner accumulated in the cavity gradually forms the toner layer having the predetermined thickness stably, and the toner constituting such layer is fed toward the position where the magnet roller is nearest the photosensitive member, it can be avoided that the toner frictionally sliding on the surface of the photosensitive member is insufficient.

Further, also when the non-magnetic toner such as the red toner which is rarely used is collected, the toner accumulated in the above-mentioned cavity is circulated in the cavity in a direction shown by the arrows C, since the magnet roller is always being rotated. Accordingly, the non-magnetic toner being fed to the cavity is mixed with the magnetic toner accumulated in the cavity, and thus, the ratio of the non-magnetic toner to the total toner will be decreased in comparison with the ratio of the non-magnetic toner when being fed. Further, since the non-magnetic toner is adhered to the magnetic toner by the agitating or mixing action and is fed at that condition to the position where the magnet roller is nearest the photosensitive member, the toner is not dropped and is not scattered.

Of course, if the toner cavity or by the portion of the magnet roller 4 and the regulating edge portion 6'a of the regulating blade 6' is enlarged, when the image forming operations using a large amount of the non-magnetic toner are repeated, the ratio of the non-magnetic toner in the cavity will be increased. However, it can be easily understood that such a condition can be easily avoided by adopting a sequence wherein developing stations using the magnetic toner are provided at a non-image area between the image areas and such toner is directly fed to the cleaning device, or by providing a means for selectively removing the non-magnetic toner from the toner cavity.

Figure 10:
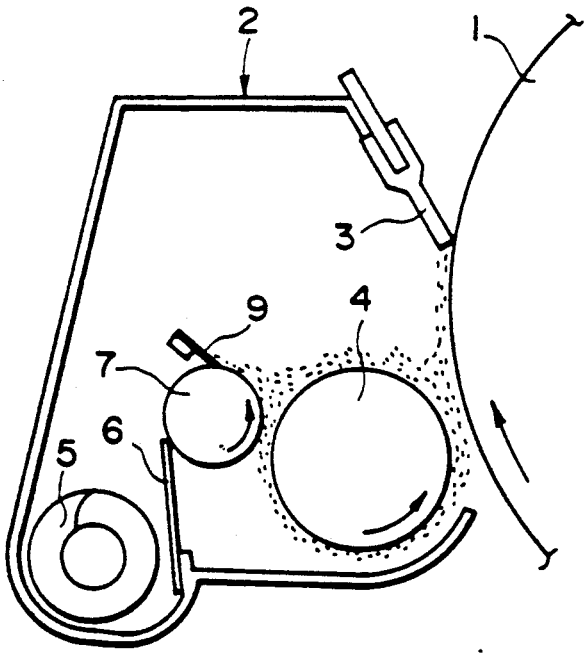

FIG. 10 shows a further embodiment of the cleaning means. The elements corresponding to those in the previous embodiment will be designated by the same reference numerals and the explanation thereof will be omitted.

In the illustrated apparatus, a regulating roller 7 made of non-magnetic stainless steel material, for regulating the thickness of the toner layer is arranged in the vicinity of the magnet roller 4, which regulating roller 7 can be rotated slower than the magnet roller 4 in a direction shown by the arrow so that a portion of the regulating roller opposed to the magnet roller is moved in a direction opposite to the movement direction of the magnet roller. In this way, by rotating the regulating roller 7 slower than the magnet roller, it is possible to reduce the possibility of the drop of the toner between the magnet roller and the regulating roller.

By using such regulating roller, it can be avoided that the toner layer having the predetermined thickness is obstructed by the fact that the foreign matter such as the paper powder entrained together with the toner collected to the cleaning device are jammed between the regulating blade and the magnet roller (when such regulating blade is used as mentioned above).

In the illustrated apparatus, as shown in FIG. 10, a scraper 9 is arranged to cooperate with a portion of the regulating roller 7 and with a portion of the magnet roller 4, thereby defining the toner cavity. Further, the toner overflowing from the toner cavity beyond the scraper 9 due to one rotation of the regulating roller 7 is discharged to the toner collecting container through the screw feeder 5. Incidentally, a partition 8 is provided for preventing the toner in the screw feeder 5 from returning back to the magnet roller 4.

With this apparatus, the toner cavity is formed between the rollers 4 and 7, and thus, it is more advantageous in the point that the toner cavity can be enlarged more than that in the previous embodiment.

As mentioned above, while the magnetic toner layer comprising the magnetic particles was formed on the magnet roller to create the magnetic brush, the magnetic brush may be formed by the aforementioned carrier (comprising iron powder). However, in this case, there arises a problem that the ability such as the cleaning ability is worsened due to the deterioration of the carrier using as the magnetic brush. Further, when both of the magnetic toner and the non-magnetic toner are cleaned, if the cleaning method using such carrier as the magnetic brush is adopted, there arises a problem that, since the adhesion force between the magnetic toner and the carrier is strong, it will be difficult to separate the magnetic toner from the carrier. Therefore, it is more preferable to form the magnetic brush by the magnetic toner as mentioned above. When the magnetic brush is formed by the carrier, it is possible to use the non-magnetic toner as the black toner. In this case, both the black toner developer and the red toner developer may be comprised of two-component toner consisting of the non-magnetic toner and the magnetic carrier, or may be comprised of single component toner consisting of the non-magnetic toner.

Further, the magnet as the magnetic particle holding means is not limited to the cylindrical roller, but may be comprised of a plurality of magnets having a plurality of magnet poles and arranged on an inner surface of a belt to form a magnetic brush which may have a longer contacting area between the magnetic brush and the photosensitive member than the contacting area when used the magnet roller.

In addition, in the above-mentioned embodiments, while an example that the amorphous silicone photosensitive member is used as the image bearing member was explained, photosensitive material such as OPC or Se may be used as the image bearing member. However, particularly when the amorphous silicone photosensitive material is used, since the foreign matter is apt to adhere to such material to worsen the image quality, it is desirable to remove the foreign matter by frictionally contacting the magnetic brush with such material.

As mentioned above, according to the present invention, since the magnetic particle holding means is moved so that the portion thereof opposed to the image bearing member is shifted in the same direction as the moving direction of the image bearing member, and since the surface speed of the magnetic particle holding means is slower than that of the image bearing member, it is possible to prevent the toner from dropping and from overflowing out of the cleaning device.

Further, it is possible to prevent of the scattering of the non-magnetic toner, particularly when the non-magnetic toner is used. The scattering of the non-magnetic toner can also be avoided by providing the toner cavity on the magnetic particle holding means to always afford the magnetic particle layer to the image bearing member stably.

In addition, according to the present invention, by removing the foreign matter from the image bearing member, the deterioration of the image quality such as the flow of the image can be prevented, thus obtaining a good image.

We claim:

1. An image forming apparatus, comprising:

a movable image bearing member for bearing a toner image thereon;

cleaning means for cleaning residual toner from said image bearing member, said cleaning means having a housing, a rotating member for holding a layer of magnetic particles provided in said housing and separated from said image bearing member by a predetermined gap, and a regulating member for regulating a thickness of the layer of magnetic particles held by said rotating member so that the thickness is greater than the width of the gap; and an accumulating portion of accumulating the magnetic particles in the vicinity of a peripheral surface of said rotating member, said accumulating portion being disposed, in a rotational direction of said rotating member, upstream of a contacting position where the magnetic particles held on said rotating member contact with said image bearing member, so that the magnetic particles accumulated in the accumulating position are subject to regulation by the regulating member.

2. An image forming apparatus according to claim 1, wherein said rotating member comprises a magnet.

3. An image forming apparatus according to claim 1, further comprising a latent image forming means for forming a latent image on said image bearing member, a developing means for developing said latent image with toner to form a toner image, and a transfer means for transferring the toner image onto a transfer material.

4. An image forming apparatus according to claim 3, wherein said image bearing member comprises a photosensitive member.

5. An image forming apparatus according to claim 4, wherein said image bearing member comprises an amorphous silicone photosensitive member.

6. An image forming apparatus according to claim 3, wherein the developing means develops said latent image on said image bearing member with non-magnetic toner.

7. An image forming apparatus according to claim 6, wherein the non-magnetic toner is a color toner.

8. An image forming apparatus according to claim 3, wherein said developing means includes a first developing unit for developing the latent image on said image bearing member with non-magnetic toner, and a second developing unit for developing the latent image on said image bearing member with magnetic toner.

9. An image forming apparatus according to claim 8, wherein the non-magnetic toner is a color toner, and the magnetic toner is a black toner.

10. An image forming apparatus according to claim 3 or claim 8, wherein said magnetic particles held by said rotating member is a non-magnetic toner.

11. An image forming apparatus according to claim 1, further comprising a cleaning member abutting said image bearing member, wherein said rotating member is arranged at an upstream side of the moving direction of said image bearing member with respect to said cleaning member.

12. An image forming apparatus according to claim 11, wherein said cleaning member comprises a blade member.

13. An image forming apparatus according to claim 11, wherein said rotating member receives the residual toner removed from said image bearing member by means of said cleaning member.

14. An image forming apparatus according to claim 1, wherein a gap d (mm), formed between said regulating member and said rotating member, is greater than a gap l (mm), formed between said image bearing member and said rotating member.

15. An image forming apparatus according to claim 14, wherein said regulating member accumulates magnetic particles dropped on said rotating member.

16. An image forming apparatus according to claim 1, wherein the following relation is satisfied:

$$V_M \leqq \frac{1}{3} V_P$$

where $V_M$ is the moving speed of the surface of said rotating member; and $V_P$ is the moving speed of the surface of said image bearing member.

17. An image forming apparatus according to claim 1, wherein said cleaning means has a cleaning member which abuts against said image bearing member.

18. An image forming apparatus according to claim 1, wherein said accumulating portion accumulates the magnetic particles from said rotating member by said regulating member which operates to remove the magnetic particles attached on a circumferential surface of said rotating member which exceed a predetermined amount.

19. An image forming apparatus according to claim 1, wherein said accumulating portion has function to remove the magnetic particles attached to a circumferential surface of said rotating member which exceed a predetermined amount.

20. An image forming apparatus, comprising:

a movable image bearing member;

means for forming a toner image on said image bearing member;

transfer means for transferring the toner image on said image bearing member onto a transfer material;

cleaning means for cleaning residual toner remaining on said image bearing member;

a rotating member for holding magnetic particles contained in the toner and for scrubbing said image bearing member with the magnetic particles held on said rotating member;

a regulating member for regulating the thickness of the magnetic particles held on said rotating member; and an accumulating portion for accumulating the magnetic particles in the vicinity of a peripheral surface of said rotating member, said accumulating portion being disposed, in a rotational direction of said rotating member, upstream of a contacting position where the magnetic particles held on said rotating member contact with said image bearing member, so that the magnetic particles accumulated in the accumulating portion are subject to regulation by the regulating member.

21. An image forming apparatus according to claim 20, wherein said rotating member is moved so that a portion thereof opposed to said image bearing member is shifted to the same direction as a moving direction of said image bearing member.

22. An image forming apparatus according to claim 21, wherein a moving speed $V_M$ (mm/sec) of a surface of said rotating member is smaller than a moving speed $V_P$ (mm/sec) of a surface image bearing member.

23. An image forming apparatus according to claim 20, wherein said rotating member comprises a magnet roller.

24. An image forming apparatus according to claim 20, wherein said toner image forming means comprises means for forming latent image on said image bearing member, first developing means for developing the latent image with non-magnetic particles, and second developing means for developing the latent image with magnetic particles.

25. An image forming apparatus according to claim 20, wherein said cleaning means comprises a cleaning blade, and said rotating member is arranged at an upstream side of the moving direction of said image bearing means with respect to said cleaning blade.

26. An image forming apparatus according to claim 20, wherein a gap d (mm), formed between said regulating member and said rotating member, is greater than a gap l (mm), formed between said image bearing member and said rotating member.

27. An image forming apparatus according to claim 20, wherein said image bearing member comprises a photosensitive member.

28. An image forming apparatus according to claim 27, wherein said image bearing member comprises an amorphous silicone photosensitive member.

29. An image forming apparatus according to claim 27, wherein said cleaning means includes a means for accumulating magnetic particles dropped on said rotating member.

30. An image forming apparatus according to claim 24, wherein the non-magnetic toner is a color toner.

31. An image forming apparatus according to claim 24, wherein the non-magnetic toner is a color toner, and the magnetic toner is a black toner.

32. An image forming apparatus according to claim 20, wherein said regulating means comprises a blade member arranged in the vicinity of said rotating member, and said blade member is arranged in a positive direction with respect to the moving direction of said magnetic particle holding means.

33. An image forming apparatus according to claim 20, wherein said toner image forming means comprises means for forming a latent image on said image bearing member, and developing means for developing the latent image with a magnetic toner, said rotating member holding the magnetic toner as the magnetic particles.

34. An image forming apparatus according to claim 20, wherein said cleaning means comprises a cleaning blade which abuts against said image bearing member, said rotating member receiving the residual toner removed from said toner bearing member by said cleaning means.

35. An image forming apparatus according to claim 20, wherein said regulating member comprises a rotary body disposed opposite to said rotating member to be rotated in a direction reverse to said rotating member at the opposed portion.

36. An image forming apparatus according to claim 20, wherein said accumulating portion accumulates the magnetic particles removed from said rotating member by said regulating member.

37. An image forming apparatus according to claim 20, wherein said regulating member is also used as said accumulating portion in common.

38. An image forming apparatus according to claim 20, wherein said regulating member is disposed at a tip end of said accumulating portion.

39. An image forming apparatus comprising:

a movable image bearing member;

cleaning means for cleaning residual toner remaining on the image bearing member;

a movable magnetic particle holding means for holding magnetic particles contained in the toner so that a layer of the held magnetic particles abuts against the image bearing member; and a regulating member for regulating a thickness of the magnetic particle layer on said magnetic particle holding means, wherein (i) a moving speed Vm of a surface of the magnetic particle holding means is slower than a moving speed Vp of a surface of the image bearing member;

(ii) a rotation direction of the magnetic particle holding means and a rotation direction of the image bearing member are opposite to one another; and (iii) a gap (d) between the regulating member and the magnetic particle holding means satisfies the condition $$d<(Vp/Vm)(l-0.15)$$

where l is a gap between the image bearing member and the magnetic particle holding means.

40. An image forming apparatus comprising:

a movable image bearing member;

cleaning means for cleaning residual toner remaining on the image bearing member;

a movable magnetic particle holding means for holding magnetic particles contained in the toner so that a layer of the held magnetic particles abuts against the image bearing member;

a regulating member for regulating a thickness of the magnetic particle layer on said magnetic particle holding means, and, an accumulating portion for accumulating the magnetic particles in the vicinity of a peripheral surface of said magnetic particle holding means, said accumulating portion being disposed, in a moving direction of said magnetic particle holding means, upstream of contacting position where the magnetic particles held on said rotating member contact with said image bearing member, so that the magnetic particles accumulated in the accumulating portion are subject to regulation by the regulating member, wherein (i) a moving speed Vm of a surface of the magnetic particle holding means is slower than a moving speed Vp of a surface of the image bearing member;

(ii) a rotation direction of the magnetic particle holding means and a rotation direction of the image bearing member are opposite to one another; and (iii) a gap (d) between the regulating member and the magnetic particle holding means is selected larger than a gap (l) between the image bearing member and the magnetic particle holding means.

41. An image forming apparatus, comprising:

a movable image bearing member;

cleaning means for removing residual toner left on said image bearing member, said cleaning means having a housing, a rotating member provided in the housing being separated from said image bearing member for holding magnetic particles by a predetermined gap, and a regulating member provided proximate to said rotating member at a distance greater than gap between said image bearing member and rotating member, for regulating the thickness of the magnetic particles held on said rotating member;

said rotating member being moved so that a portion thereof opposed to said image bearing member is shifted in the same direction as a moving direction of said image bearing member and satisfying the relationship:

$$V_M<V_P \text{ and } d\leqq[V_P/V_M]\,(l-0.15)$$

where $V_M$ is the moving speed of surface of said rotating member;

$V_P$ is the moving speed of surface of said image bearing member;

d is the distance between said rotating member and said regulating member; and l is the width of the gap between said rotating member and said image bearing member.

42. An image forming apparatus according to claim 41, wherein said rotating member comprises a magnet roller.

43. An image forming apparatus according to claim 41, further comprising latent image forming means for forming a latent image on said image bearing member, developing means for developing the latent image to form a toner image, and transfer means for transferring the toner image onto a transfer material.

44. An image forming apparatus according to claim 43, wherein said image bearing member comprises a photosensitive member.

45. An image forming apparatus according to claim 44, wherein said image bearing member comprises an amorphous silicone photosensitive member.

46. An image forming apparatus according to claim 43, wherein said developing means comprises a first developing unit for developing the latent image on said image bearing member by a non-magnetic toner, and a second developing unit for developing the latent image on said image bearing member by a magnetic toner.

47. An image forming apparatus according to claim 46, wherein the magnetic particles held by said rotating member comprises a magnetic toner.

48. An image forming apparatus according to claim 46, wherein the non-magnetic toner is a color toner, and the magnetic toner is a black toner.

49. An image forming apparatus according to claim 41, wherein said cleaning means comprises a cleaning member which abuts against said image bearing member.

50. An image forming apparatus according to claim 49, wherein said rotating member is arranged at an upstream side of the moving direction of said image bearing member with respect to said cleaning member.

51. An image forming apparatus according to claim 50, wherein said cleaning member comprises a blade member.

52. An image forming apparatus according to claim 50, wherein said rotating member receives the residual toner removed from said image bearing member by said cleaning member.

53. An image forming apparatus according to claim 41, wherein following relationship is satisfied:

$$V_M \leqq V_P.$$

54. An image forming apparatus, comprising:

a movable image bearing member;

cleaning means for cleaning residual toner remaining on said image bearing member, said cleaning member having a cleaning blade abutted against said image bearing member under pressure, a rotating member separated by a gap from said image bearing member, and a regulating member proximate to said rotating member at a distance which is greater than d gap between said image bearing member and rotating member, for regulating the thickness of magnetic particles held on said rotating member; and said rotating member being moved so that a portion thereof applied to said image bearing member is shifted in the same direction as the moving direction of said image bearing member;

where the following relationship is satisfied:

$$V_M > V_P / 3\{3(h-d)-2\}$$

$h > d$ and $$\{3(h-d)-2\} > 0$$

where $V_M$ is the moving speed of surface of said rotating member;

$V_P$ is the moving speed of surface of said image bearing member;

d is the distance between said rotating member and regulating member; and h is the distance from the point where said cleaning blade contacts said image bearing member to said rotating member.

55. An image forming apparatus according to claim 54, wherein said rotating member comprises a magnet roller.

56. An image forming apparatus according to claim 54, further comprising latent image forming means for forming a latent image on said image bearing member, a developing means for developing the latent image to form the toner image, and transfer means for transferring the toner image onto a transfer material.

57. An image forming apparatus according to claim 56, wherein said developing means comprises a first developing unit for developing the latent image on said image bearing member by non-magnetic toner and a second developing unit for developing the latent image on said image bearing member with magnetic toner.

58. An image forming apparatus according to claim 57, wherein the magnetic particles held by said rotating member is a magnetic toner.

59. An image forming apparatus according to claim 57, wherein the non-magnetic toner is a color toner, and the magnetic toner is a black toner.

60. An image forming apparatus according to claim 54, wherein said image bearing member comprises a photosensitive member.

61. An image forming apparatus according to claim 60, wherein said image bearing member comprises an amorphous silicone photosensitive member.

62. An image forming apparatus according to claim 54, wherein the following relationship is satisfied:

$$V_M \leqq V_P.$$

63. An image forming apparatus according to claim 54, wherein said rotating member receives the residual toner removed from said image bearing member by said cleaning blade.

* * * * *

UNITED STATES PATENT AND TRADEMARK OFFICE

CERTIFICATE OF CORRECTION

PATENT NO. : 5,249,025 Page 1 of 3

DATED : September 28, 1993

INVENTOR(S) : Nobuo Nakazawa, et al.

It is certified that error appears in the above-identified patent and that said Letters Patent is hereby corrected as shown below:

COLUMN 1:

line 11, "a" should read --an--;
line 32, "if" should read --is--; and
line 67, "are" should read --is--.

COLUMN 2:

line 2, "were" should read --are--.

COLUMN 3:

line 2, "O" should be deleted; and
line 57, "view" should read --views--.

COLUMN 4:

line 39, "Here, as the" should read --The--.

COLUMN 5:

line 66, "sensitive" should read --sensitive member--.

UNITED STATES PATENT AND TRADEMARK OFFICE

CERTIFICATE OF CORRECTION

PATENT NO. : 5,249,025

DATED : September 28, 1993

INVENTOR(S) : Nobuo Nakazawa, et al.

It is certified that error appears in the above-identified patent and that said Letters Patent is hereby corrected as shown below:

COLUMN 8:

line 49, "locking" should read --rocking--.

COLUMN 9:

line 46, "collected to" should read --collected by--; and
line 47, "device" should read --device is--.

COLUMN 10:

line 9, "continue" should read --continued--; and
line 31, "or" should be deleted.

UNITED STATES PATENT AND TRADEMARK OFFICE

CERTIFICATE OF CORRECTION

PATENT NO. : 5,249,025 Page 3 of 3

DATED : September 28, 1993

INVENTOR(S) : Nobuo Nakazawa, et al.

It is certified that error appears in the above-identified patent and that said Letters Patent is hereby corrected as shown below:

COLUMN 11:

line 45, "used the" should read --used as the--.

COLUMN 12:

line 22, "of" should read --for--;
line 30, "position" should read --portion--; and
line 64, "is" should read --are--.

COLUMN 16:

line 47, "apparatus" should read --member--;
line 59, "comprises" should read --comprise--.

COLUMN 17:

line 25, "d gap" should read --a gap--.

Signed and Sealed this

Second Day of August, 1994

Bruce Lehman

*Attest:*

BRUCE LEHMAN

*Attesting Officer*

*Commissioner of Patents and Trademarks*